United States Patent [19]

Ahrweiler et al.

[11] 4,033,153

[45] July 5, 1977

[54] APPARATUS FOR PRODUCING PATTERNS ON ADVANCING STRIPS

[75] Inventors: Karl-Heinz Ahrweiler, Krefeld; Ferdinand Leifeld, Tonis-Vorst, both of Germany

[73] Assignee: Eduard Küstes, Krefeld-Forstwald, Germany

[22] Filed: Mar. 17, 1976

[21] Appl. No.: 667,482

Related U.S. Application Data

[63] Continuation of Ser. No. 483,431, June 26, 1974, abandoned.

[30] Foreign Application Priority Data

July 11, 1973 Germany ..... 2335234

[52] U.S. Cl. ..... 68/205 R

[51] Int. Cl.[2] ..... D06B 1/04

[58] Field of Search .... 68/205 R; 118/301, DIG. 4; 198/68

[56] References Cited

UNITED STATES PATENTS

| | | | |
|---|---|---|---|
| 2,842,242 | 7/1958 | Patterson | 198/68 |
| 3,342,300 | 9/1967 | Foy | 198/68 |
| 3,570,275 | 3/1971 | Weber et al. | 68/205 R |
| 3,683,649 | 8/1972 | Takriti et al. | 68/205 R |
| 3,800,568 | 4/1974 | Takriti et al. | 68/205 R |

*Primary Examiner*—Richard E. Aegerter
*Assistant Examiner*—L. Footland
*Attorney, Agent, or Firm*—Kenyon & Kenyon, Reilly, Carr & Chapin

[57] ABSTRACT

Apparatus for producing pattern on advancing strips such as strips of textile and similar materials in which a roller rotates in a trough picking up a liquid such as a dye used for producing the pattern and carrying the liquid to a scraper blade slanted toward the strip of material with the scraper blade scraping off the liquid adhering to the roller which is then permitted to run down onto a strip moving therebelow. In accordance with the present invention, a plurality of movable channels are provided at the bottom end of the scraper plate, the channels being movable between one position in which the liquid is permitted to flow onto the moving strip and another position in which the liquid is directed to a catch pan from which it can be returned to the trough with means provided to oscillate the channels so as to produce a desired pattern on the strip.

20 Claims, 12 Drawing Figures

Fig. 4
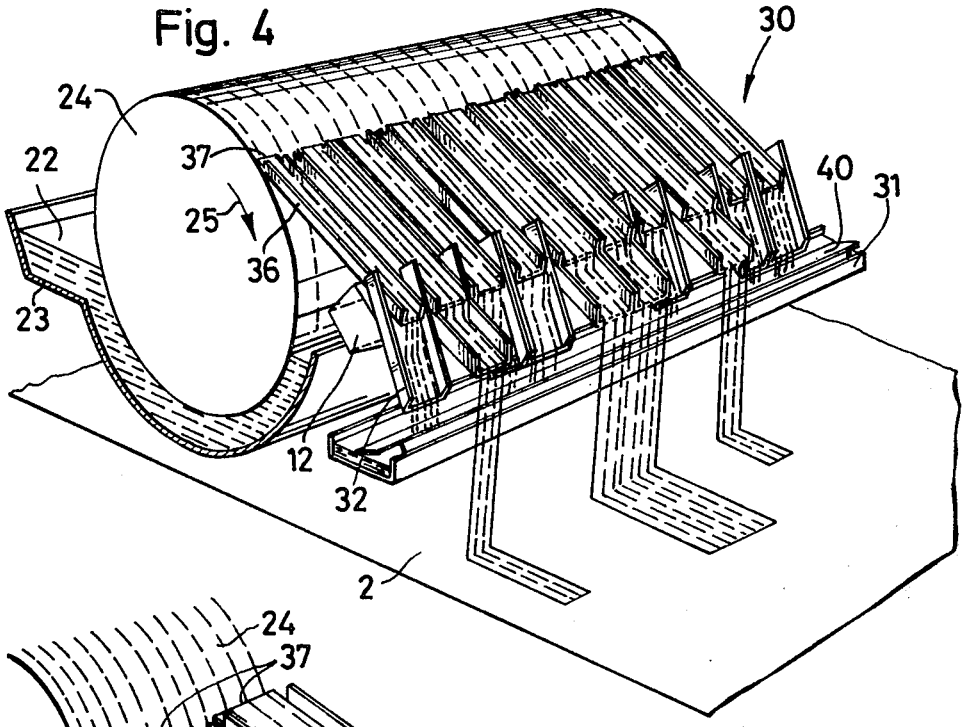
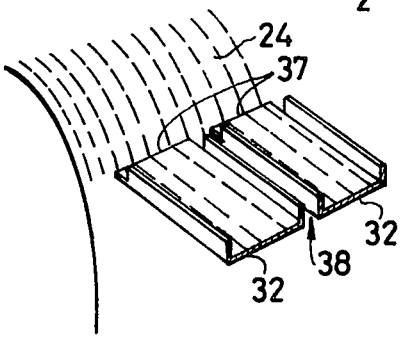
Fig. 5
Fig. 6
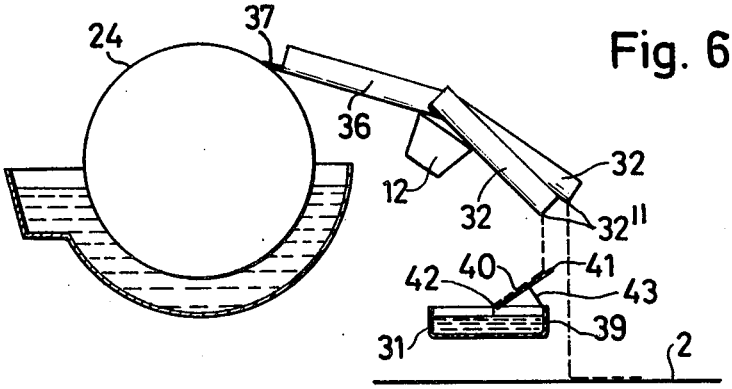

APPARATUS FOR PRODUCING PATTERNS ON ADVANCING STRIPS

This is a continuation of application Ser. No. 483,431 filed June 26, 1974 now abandoned.

BACKGROUND OF THE INVENTION

This invention relates to apparatus for producing patterns on advancing strips such as strips of textile and the like in general and more particularly to an improved apparatus of this nature which employs a plurality of oscillating troughs at the bottom of a scraper plate scraping a pattern producing liquid from a roller rotating with a portion thereof immersed in a trough containing the liquid.

Various means of producing patterns on textile materials such as rugs and the like have been developed. In one such apparatus disclosed in U.S. Pat. No. 3,683,649. Grids are interposed between an inclined scraping plate contacting a roller containing the liquid to interrupt the path of the flowing liquid and cause it to be distributed on the material moving below in an irregular pattern. Although equipment of this nature works quite well, it is limited in the types of patterns it can produce. In the textile industry, there is a constant need for more and varied patterns. In view of this, it is the object of the present invention to provide an apparatus for producing a selective and variable pattern of a predetermined nature on a strip of material such as textile material.

SUMMARY OF THE INVENTION

The present invention provide such pattern producing apparatus starting with a roller immersed in a trough of pattern producing liquid and a scraper plate or the like sloped downwardly and scraping the pattern producing liquid from the roller. At the lower end of the scraper plate, a plurality of movable channels are installed side by side across the width of the plate with means provided to individually move the channels between two limits; one limit being one in which the liquid is allowed to drip onto the moving strip below and another limit in which the liquid is directed to a catch pan from which it can be returned to the trough. Through this arrangement and particularly through a predetermined oscillation, of the plurality of channels arranged across the width of the scraper plate, predetermined asthetically pleasing patterns can be formed on the strip moving below.

The fineness of the pattern which can be obtained depends on the width of the liquid conducting channels. Typically, for patterning carpets, sufficient fineness is obtained with a width of the individual liquid conducting channels selected to be between 10 and 15 mm. To obtain the necessary type of patterning, movement of the individual channels between the two limits must be selected so that the channel remains at the one limit long enough for liquid to flow onto the strip and in the other position long enough for a portion of the liquid to flow into the catch pan. Various means of obtaining the motion are disclosed. In a first disclosed embodiment, the channels are pivoted about a transverse shaft. In this arrangement, the channels are located below the scraper plate with liquid falling from the edge of the scraper plate into the channel below. The pivotal center for the channels may be a stationary shaft but may also be a movable shaft so that the pivot point can be variable. In other disclosed embodiments, rather than pivoting, the channels are shifted laterally from a position where they are over the catch pan to another position where the liquid is allowed to flow onto this strip below. Again, the channels may be located below the scraper plate. Various types of shifting are disclosed; the shift may be horizontal or may be a shift parallel to the scraper plate. Typically, in accordance with the present invention, the channels remain stationary in the limit position in which they deliver liquid onto the strip permitting a smooth flow of liquid thereon. However, it is also possible to provide an oscillating drive causing an oscillation of the channels between their limit positions. In this type of operation, it is preferable that the delivery point of the liquid conducting channel move rapidly. The motion should not be a slow to and fro motion but a vigorous oscillation which tends to fling particles of the liquid. This causes individual drops of colored liquid to reach the strip as such with the drops superimposed on the patterning obtained by the invention. Oscillation may take place during the period where liquid is being deposited on strip or may be an oscillation between the liquid depositing limit position and the position where liquid is returned to the catch pan. This type of operation has the same type flinging effect.

It is, of course, also possible to use slow oscillations to influence the pattern produced. Since such an oscillation is superimposed on the advance of the strip, it produces different densities of the liquid in a lengthwise direction of strip zones. The fineness of the pattern obtainable in a lengthwise direction or, considering the problem from another point of view, the obtainable speed of advance of a strip during patterning depends on the frequency with which the liquid conducting channels are moved back and forth between their limit positions. Clearly, an increase in pattern fineness or operating speed is possible if the channels are switched at a high speed.

Disclosed is a preferred switching drive which uses electromagnetic switching for movement of the liquid conducting channels. A drive of this nature can easily be operated by an electrical control resulting in a transmission of control pulses which in a manner which is free from inertial effects. This is particularly suitable for the control and for the easy management of an installation having a plurality of elements in accordance with the present invention. As is evident, in order to have a clearly distinct spacing of the liquid delivery positions of the channels at their two limit positions and therefor a clean separation of the supply, a considerable shift is required for the channels between their two limit positions. To obtain such a large shift using electromagnets becomes difficult. The present invention discloses a solution to this problem permitting electric or electromagnetic drive of the channels with its advantages and at the same time permitting sufficient travel and high switching frequency. In accordance with the preferred embodiment of the invention, the electromagnetic drive comprises, for each channel, a pair of permanent magnets and a DC electromagnet, also arranged as a pair of magnets. One pair, preferably the electromagnet is stationary and the other pair, preferably the permanent magnet attached to the channels. Control means are provided to simultaneously reverse the polarity of the two DC electromagnets of each pair. As a result, at each limit position one pair of magnets is available to provide, upon a switch over or reversal of polarity, a repulsion of the two magnets with the repulsion being of a large magnitude due to the close pole spacing. As the distance becomes greater between these two magnets the attraction force of the other pair of magnets becomes greater resulting in a large force over the full travel distance. As disclosed, the action occurs alternatively for each reversal so that a high switching frequency becomes possible. In each case as the spacing at one pole becomes greater the spacing at the other pole becomes lesser permitting a greater stroke length than with a single electromagnet arrangement.

Various forms of construction of the liquid carrying channels and the scraper plate are disclosed. In one disclosed form of construction the liquid carrying channels comprise elongated channels opened at the top and slanting toward the strip. Using an open form facilitates cleaning and avoids changes of the flow cross section which occur in the case of closed channels because of deposits of the patterning liquid and bubbles in the liquid. The channels may be inclined at the same slope as the scraper plate or at a different slope. In most of the embodiments illustrated, the channels move below the scraper plate with means for moving them also located therebelow and adjacent to the channels. In other embodiments, the channels and means moving them are outside in front of the scraper plate. In the first illustrated embodiment, a typical prior art sloping scraper plate is employed with the liquid running from the lower edge thereof into the plurality of channels. In order to avoid an undesirable dripping of the patterning liquid between the individual channels, a further embodiment of the invention illustrates partitioning of the scraper plate to direct the flow into the channels without dripping. These may extend over the full length of the plate or may be placed only at the bottom thereof, near the edge where the liquid flows off into the channels. Also illustrated is an arrangement in which cutouts are provided at the top of the scraper plate aligned with the spaces between channels at the bottom so that liquid will not be scraped off the roller in these areas. These may also be used as illustrated in combination with means separating these scraper plates into individual channels.

In a further embodiment, rather than using a single scraper plate, individual scraper plates, one being associated with each of the channels and in the form of a channel itself are used. This permits transfer of liquid to a channel by an individual scraper means.

During movement of the liquid conducting channels, the edge from which liquid is delivered travels a distance to above the catch pan which can result in patterning liquids running down continuously, during the movement. As a result, drops can form at the edge of the catch pan and drip uncontrolled onto the strip. To avoid this problem there is illustrated an arrangement in which a drop catching plate extending across the strip with one edge just outside the edge of the catch pan and tilted toward its interior is installed over the catch pan. This provides a passage for the patterning liquid opposite the rim of the catch pan preventing uncontrolled dripping. In passing over the edge of the catch pan, the patterning liquid encounters the drip catch plate and runs partially thereover and partially on its underside into the catch pan. Drops that are formed cannot reach the strip but are instead conducted by the plate into the catch pan.

BRIEF DESCRIPTION OF DRAWINGS

FIG. 4 is a perspective view of a third embodiment of the invention.

FIG. 5 is a perspective view showing a portion of the embodiment of FIG. 4 in more detail.

FIG. 6 is an elevation view of the embodiment of FIG. 4.

DETAILED DESCRIPTION OF PREFERRED EMBODIMENT

Figure 1:
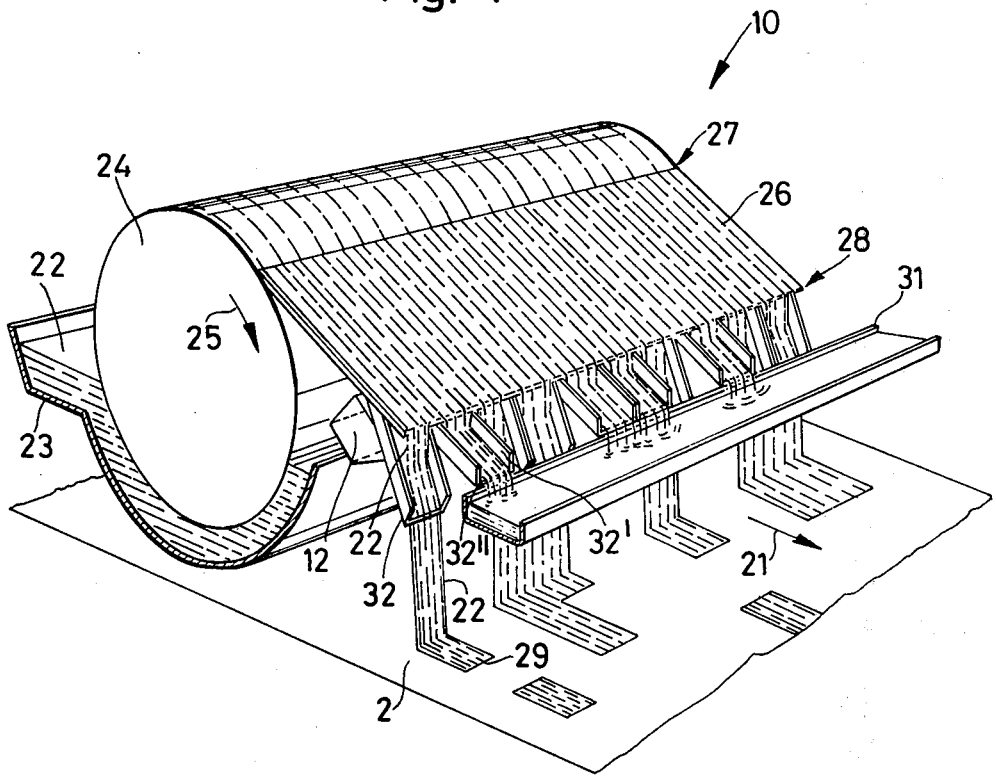
FIG. 1 is a perspective view of a first embodiment of the present invention.

FIG. 1 illustrates a first embodiment of the pattern producing apparatus of the present invention. The apparatus indicated as 10 provides a predetermined pattern on a strip or web 2 moving therebelow. The patterning liquid 22 which in conventional fashion will comprise a dye or the like is contained within a trough 23. A roller 24 is supported for rotation about its longitudinal axis in the direction of arrow 25 in conventional fashion. Liquid picked up by the roller 24 is carried thereon and at line 27 is scraped off by a scraper plate 26. Liquid flows down the scraper plate 26 until it flows off the plate at the edge 28.

In accordance with the present invention there are installed below the edge 28 of the scraper plate 26 a plurality of abutting or closely spaced channels 32. As illustrated, these are generally of a U-shaped cross section and are pivoted for movement between two positions as illustrated by the positions of the adjacent channels 32 and 32'. Switching between these two limit positions is done electromagnetically using electromagnetic switching units contained within a housing 12. The electromagnetic switching units will be described in more detail below in connection with FIGS. 10, 11 and 12. The channels may be moved between the position illustrated by channel 32 and that illustrated by 32' at a high speed through the angular range between the two limit positions. When in the position of channel 32, the patterning liquid flows down from the plate 26 into the channel and forms a pattern field 29 on the sheet 2. The adjacent channel 32' to the right of channel 32 in its upper limit position supplies its liquid to a catch pan 31. Catch pan 31 is disposed across the full width of the arrangement so that it can catch liquid from any of the channels 32 and 32'. It is arranged so that the lower edge 32'' of the channel 32' will be above it when in the upper limit position. As illustrated by FIG. 1, a plurality of these channels 32 and 32' each pivotable between the two limit positions are arranged side-by-side across the width of the arrangement. Each can be pivoted up and down independently of the others by the electromagnetic switching means contained within the housing 12. Depending on the control of the channels, there will be produced on a strip 2, a pattern-like application of liquid as illustrated. The fineness of the pattern across the strip 2 is determined by the number, and thus the width of the channels. When patterning carpets or the like, a width of approximately 10mm gives good pattern fineness. Using the drive means to be described below and channels of this size and operating at frequencies of about 15 hz permit sufficient pattern fineness both in the transverse and lengthwise direction of the strip. On the other hand, if a high degree of fineness in a lengthwise direction is not necessary, operation at this frequency permits a relatively fast advancing speed of the strip 2 in the direction of arrow 21 to be used. Operation of the channels 32 at a high frequency results in a flinging effect of the patterning liquid 22 so that it no longer flows smoothly from the lower edge of the channels 32 but instead arrives on the strip 2 in individual drops. Through this flinging a unique pattern is obtained.

Figure 2:
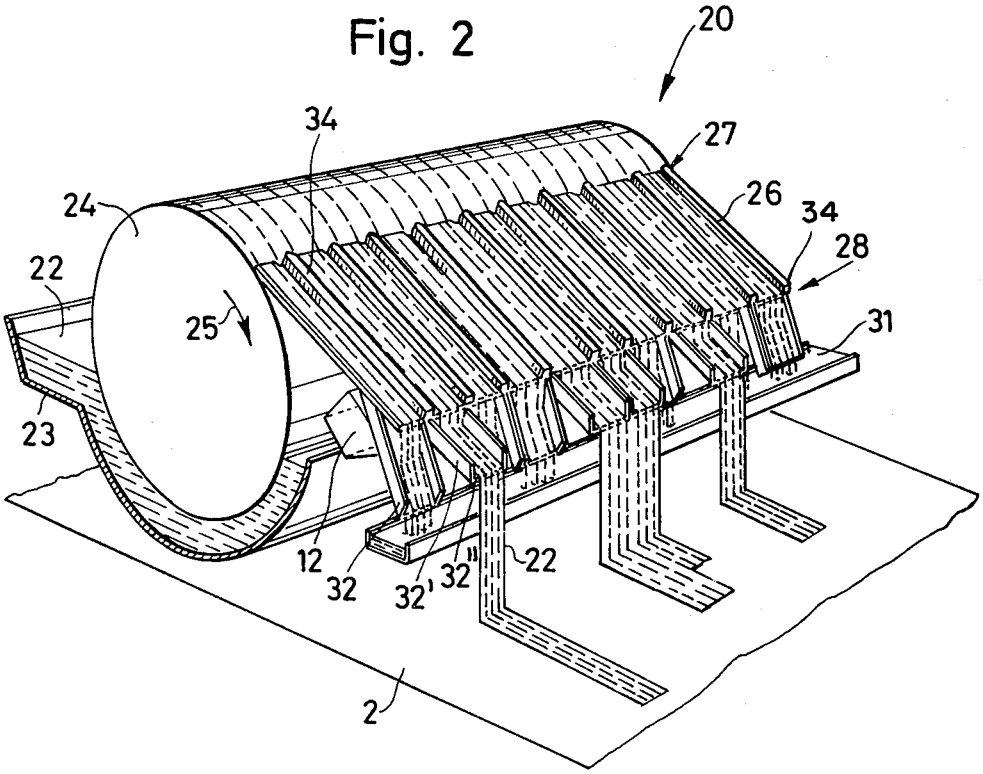
FIG. 2 is a similar view of a second embodiment.

A second embodiment of the invention is illustrated by FIG. 2. In this embodiment, the channel 32 at its lower limit position is arranged to deposit its liquid in the catch pan 31 while the adjacent channel 32' in the upper limit position results in flow of the liquid down onto the strip 2. This is essentially the same channel arrangement as shown in FIG. 1 with the catch pan 31 placed lower and closer to the roller 24 as compared to its position in FIG. 1. In all other respects operation of the channel switching is essentially as described above.

Figure 3:
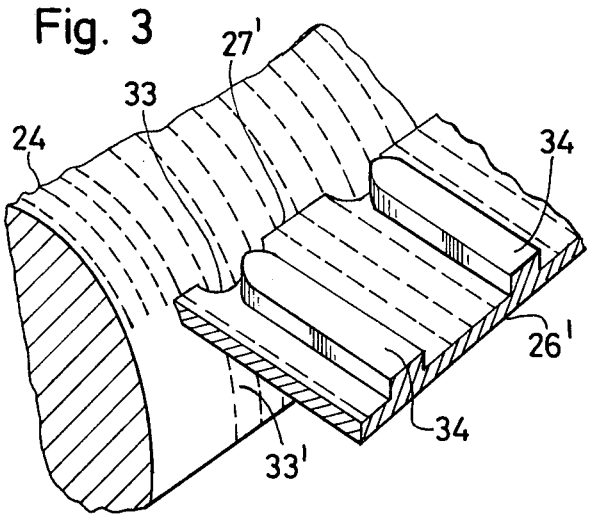
FIG. 3 is a perspective view showing a portion of the embodiment of FIG. 2 in greater detail.

FIG. 2 also illustrates a number of ways of overcoming a problem which can result due to liquid flowing off the plate 26 into cracks between adjacent channels such as the channels 32 and 32'. On the plate 26' are shown cutouts at the top. These cutouts 33 are more clearly illustrated on FIG. 3. Cutouts 33 are aligned with the point at the bottom of the plate 26' where two channels abut. Along the line 27 where liquid is scraped from the roller 24, these cutouts result in liquid only being scraped off at the portions 27' indicated on FIG. 3. The patterning liquid in the areas where the cutouts 33 are provided is not scraped off but continues with the roller 24 as the liquid 33'. As an alternate, or addition to provide even better separation and avoid dripping between channels, there are also provided barriers 34 which break up the plate 26' into a plurality of separate channels which are aligned with the channels 32 and 32'. With this arrangement, it is impossible for the liquid to flow off the edge 28 of the plate 26' in the space between adjacent channels.

Figure 7:
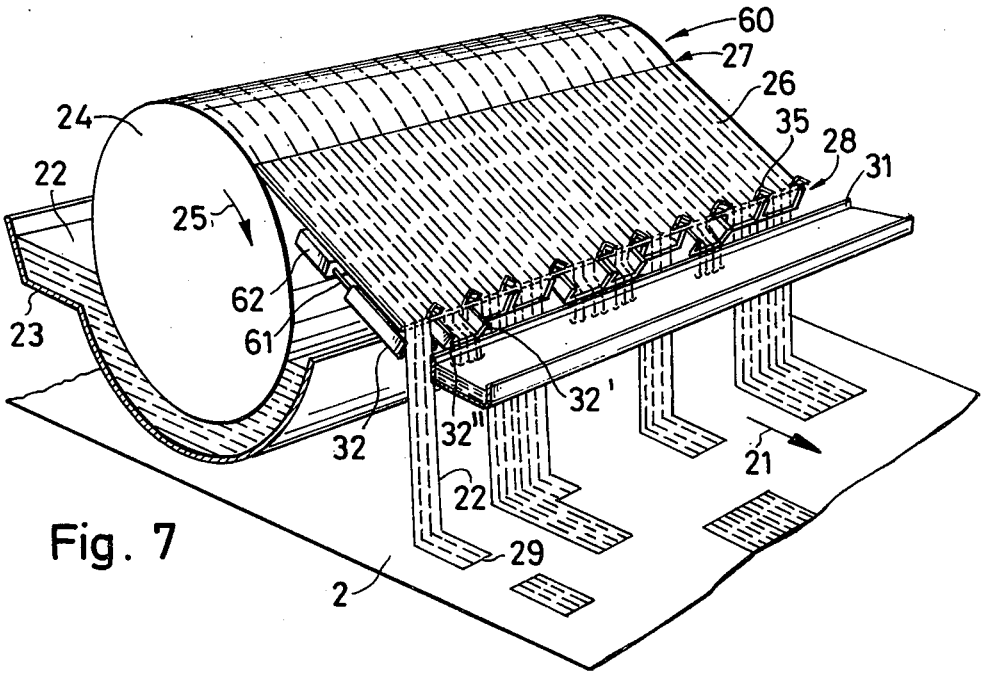
FIG. 7 is a perspective view of a fourth embodiment of the invention.

An alternate form of achieving the same result is illustrated by the arrangement on the right hand side of FIG. 7. Here, instead of having barriers 34 extending all the way down the plate 26, short barriers 35 are installed at the bottom of the plate near the edge 28. These are essentially triangularly shaped pieces having their apex pointing upward. The liquid flowing down the plate 26 when encountering the barriers 35 is directed to one side or the other and into corresponding channels below the edge 28. Liquid is prevented from flowing off the edge 28 in the intermediate area between channels. In this arrangement, the upper edge 27 of the plate can be made smooth. The plate itself can be smooth or, alternatively, in order to produce a smooth flow along a desired line of descent, may have uniform small ribs.

A further embodiment of the invention is illustrated by the apparatus 30 of FIG. 4. The arrangement of the channels 32 and catch pan 31 along with their electromagnetic control by electromagnetic switching apparatus in the housing 12 is exactly the same as that described in connection with FIG. 2. The primary difference in this apparatus is that instead of a single scraper plate 26', a plurality of individual scraper blades on the end of plates of U-shaped cross section, one being associated with each of the channels 32 is provided. As a result, each channel 32 has its own scraper blade 36 directing a flow of liquid thereto. As illustrated on FIGS. 4 and 5, each of the scraper blades 36 has an upper edge 37 scraping the liquid from the drum 24. As a result, all liquid scraped by the individual scrapers 36 will be directed into a corresponding channel 32 and then be directed either to the catch pan 31 or onto the strip 2 in the manner described above. Sufficient spacing is provided between the scrapers 36 to permit the legs of adjacent channels 32 to pass therebetween so that the pivoting mobility of the channels 32 is not impaired. In the space 38 between the scrapers 36, patterning liquid is not scraped off the roller 24 but returns with it to the trough 23.

An elevation view of the arrangement of FIG. 4 is illustrated by FIG. 6. As the channel 32 moves from the position where it is depositing liquid on the sheet 2 to a position over the catch pan 31, it travels past the edge 39 of the catch pan. If nothing further were done, liquid would be deposited on this edge 39 and would drip off the edge in an uncontrolled manner. To prevent this from happening, a drip catching plate 40 extending across the width of the strip 2 is attached to the catch pan 31 above its edge 39. The upper edge 41 of the plate 40 extends out past the edge 39. Its lower edge 42 is situated within the confines of the catch pan 31. The plate 40 is substantially unobstructed on its bottom side, being fastened to the catch pan 31 by means of a single support 43 of narrow width. Thus, when drops form at the upper edge 41 of the plate 40 they can run down the underside of the plate and upon reaching the lower edge 42 drop in the catch pan 31 without being able to reach the strip 2. Thus, the edge 41 forms an effective cutoff point for the flow of liquid and prevents uncontrolled dripping.

Figure 8:
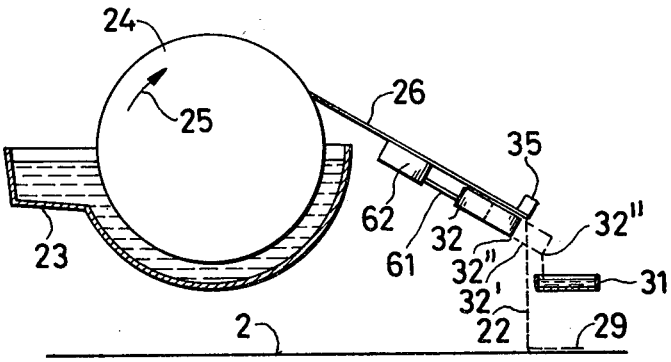
FIG. 8 is an elevation view of the embodiment of FIG. 7.

A further embodiment of the invention in which lateral rather than pivotal motion of the channels 32 is used is illustrated by FIGS. 7 and 8. This apparatus indicated generally as 60 is, in respect to the trough 23, roller 24, and plate 26 identical to the embodiment of FIG. 1. The channels 32 rather than being pivoted are instead mounted on the end of a rod 61 operated by an electromagnetic drive 62. The channels 32 can be moved from the rearward position illustrated in solid lines on FIG. 8 to the forward position illustrated in dotted lines. In the rearward position, liquid 22 is allowed to flow from the edge of the plate 26 to form a pattern 29 on the strip 2. In the forward position shown in dotted lines indicated by the channel 32' the liquid flows from the edge 32'' into the catch pan 31.

Figure 9:
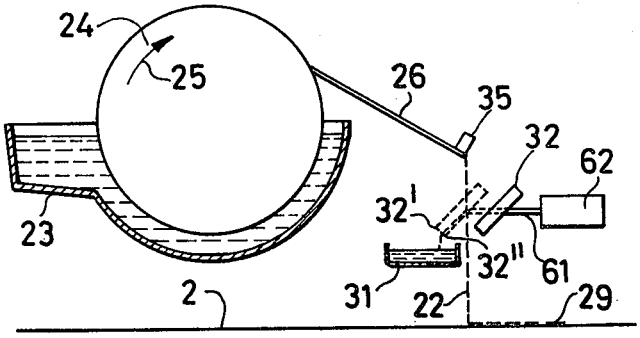
FIG. 9 is an elevation view of a modified form of construction.

Rather than permitting the liquid 22 to flow directly from the edge of the plate 26 onto the strip 2, the rearward limit position can be established so that the liquid 22 flows partially through the channel 32. In that case, the rearward position of the channel 32 would not be as far back as shown on FIG. 8. In that case, liquid will always flow through the channels 32. A further modification of the invention using rectalinear motion is illustrated by the view of FIG. 9. Again, the basic arrangement of the trough 23, roller 24 and scraper plate 26 is as described above. Here, rather than having the channels 32 located below the scraper plate 26 they are located in front thereof. The electromagnetic drive means 62 are mounted in front of the scraper plate 26 and have rods 61 extending therefrom to which the channels 32 are mounted. As illustrated, the channel 32 can be moved from a position shown in solid lines which permits the liquid 22 to flow directly off the edge of plate 26 to form a pattern 29 on the strip 2 to the position 32′ shown in dotted lines where the flow is intercepted and directed to the catch pan 31.

Figure 10:
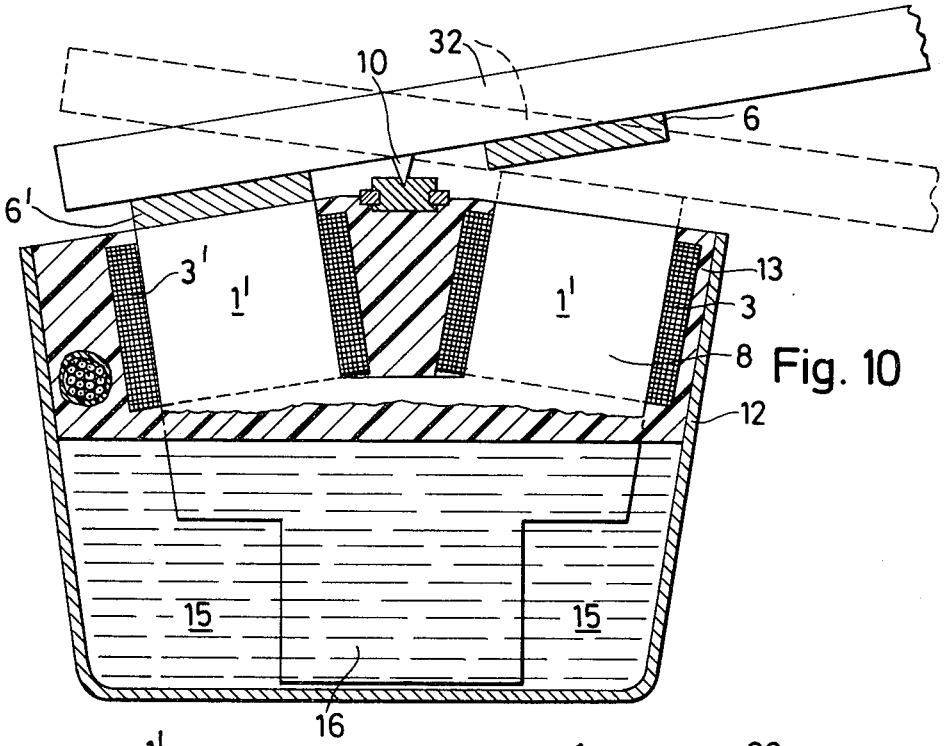
FIG. 10 is a cross section through an electromagnetic switching unit which may be used with the embodiment of FIGS. 1, 2 and 4.
Figure 11:
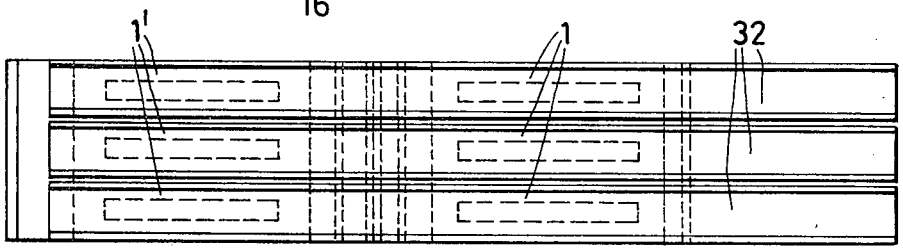
FIG. 11 is a plan view of a portion of the arrangement illustrated by FIG. 10.

FIGS. 10 and 11 illustrate an electromagnetic drive which may be used to obtain the pivoting described in connection with FIGS. 1, 2 and 4. Within the housing 12 illustrated on those figures, two electromagnets 1 and 1′ are disposed on the branches of a U-shaped iron core 8. The channel 32 is pivoted on a knife edge 10 above the electromagnets 1 and 1′ forming the armature. The channel 32 is maintained with its knife edge 10 properly positioned through the use of a spring [not shown]. Mounted on each side of the knife edge is a permanent magnet 6 and a permanent magnet 6′. These are positioned to align with the electromagnets 1 and 1′ respectively. The channel 32 can pivot between the position shown in solid lines where the permanent magnet 6′ is in contact with the electromagnet 1′ and the position shown in dotted lines where the permanent magnet 6 is in contact with the electromagnet 1. In the position in solid lines, the magnet 1 will be energized to result in a repulsion between it and the magnet 6 and the magnet 1′ to attract magnet 6′. When it is desired to change positions, the polarity of the windings 3 and 3′ of the magnets 1 and 1′ is reversed. This results in a repulsion between the magnets 1′ and 6′ and an attraction between the magnets 1 and 6. At the beginning of the switch over, the magnets 1′ and 6′ which are close together will have a high repulsive force with a correspondingly low attractive force being present between the magnets 1 and 6. However, as the channel 32 begins to move from the position shown in solid lines to that shown in dotted lines, the attraction force between the magnets 1 and 6 begins to increase as the repulsive force between the magnets 1′ and 6′ decreases. As a result, an essentially constant force is maintained through the complete switch over thereby permitting relatively high frequency switching between the two positions.

The housing 12 in which the electromagnets mounted on the core 8 are installed is generally pot shaped, and is opened at its top. The U-shape iron-core 8 contains an extension 16 and installed with the two legs pointing upwards. In the lower region of the housing 12 a channel for cooling liquid is provided. This is formed by casting a material 13 in the upper portion of the channel 12 surrounding the core 8 and electromagnets 1 and 1′. Any well-known casting resin or the like may be used for this purpose. The extension 16 of the core 8 is surrounded on all sides by a cooling medium such as air or water, so that the heat generated by the electromagnet is properly removed.

As illustrated by FIG. 11, a plurality of electromagnets 1 and 1′ are disposed beside each other, a pair being provided for each of the channels 32. All electromagnets are located within the housing 12 which extends across the full width of the arrangement.

Similar electromagnetic drives may be mounted within housing 62 such as those illustrated by FIGS. 8 and 9 to provide for the necessary lateral shift of the channels described in connection therewith.

Either type of electromagnetic drive will have associated therewith control equipment to produce a desired oscillation. Oscillation may be between the two limit positions described above i.e., with liquid either being deposited on the strip or into the catch pan 31, or may be an oscillation of a certain amplitude away from the limit position where liquid is being deposited onto the strip. As noted above, the oscillation is selected to be of sufficient rapidity so that liquid is flung off the edge of the channels 32 and scattered on the strip 2.

Figure 12:
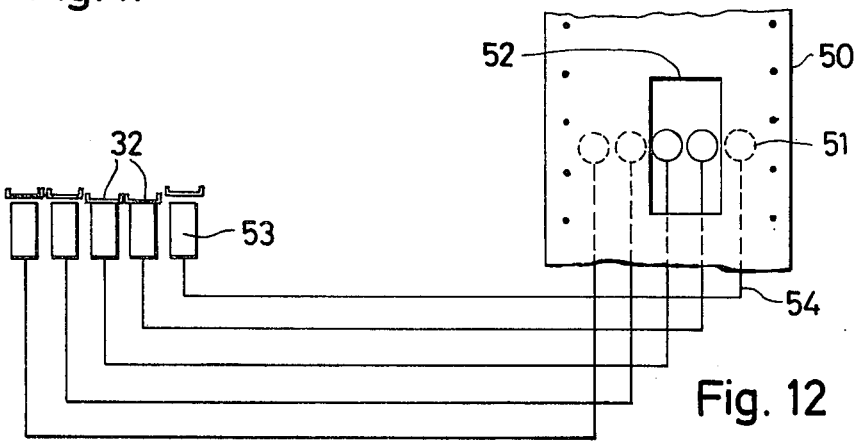
FIG. 12 is a schematic illustration of the control arrangement for a controlling the operation of the electromagnetic switching of FIGS. 10 and 11.

FIG. 12 illustrates in schematic form a drive for carrying out this type of oscillation. Control of the electromagnetic position is through the use of a perforated paper tape 50. The pattern desired on the strip 2 is coded onto the paper tape 50. It should be noted that a punched paper tape 50 is only one example of an information carrier. Other forms of construction such as a transparent foil carrying the pattern may also be used. The paper tape 50 will, of course, be considerably narrower than the strip 2 whose pattern is coated thereon. For example, it may have a width of the order of magnitude of 100 to 300 mm. The strip may be of any desired length and it is caused to travel synchronously with the advance of the strip 2. Typically, the punched tape 50 is sensed photoelectrically. Disposed close together across the width of the punched tape 50 are photoelectric elements 51 such as photocells, photoresistances or the like. For purposes of illustration, five such photoelectric elements are shown corresponding to five channels 32. It will be recognized that a much larger plurality of channels 32 will normally be provided with a correspondingly large number of photoelectric elements 51 controlling the individual channels. At points on the paper tape 50 where there is a perforation, such as a perforation 52, associated photoelectric elements 51 receive a full intensity of the light and deliver a voltage, cause an alteration of its resistance, or the like. In well-known fashion, a control signal which when amplified can control electromagnetic switching units is provided. Each unit 53 corresponds to a set of magnets 1 and 1′ and 6 and 6′ as described in connection with FIGS. 7 and 8. In the illustration of FIG. 12, the third and fourth photocells from the left are outputting signals while the three remaining elements 51 are covered by the paper of the paper tape and are not activated. The electromagnetic switching units which operate the channels 32 are coupled to the photoelectric elements in such a way that the sequence of the both is the same; that is the first photoelectric element 51 at the left is connected to the first electromagnet switching unit 53 at the left and so on. Since the illustration of FIG. 12 the third and fourth photoelectric element from the left have a signal thereon, the third and fourth electromagnetic units 53 are operated to pivot their corresponding channels 32 to permit the patterning liquid to reach the strip 2 or to be kept away from the strip 2 depending on the particular system design. Naturally, with the remaining channels 32 the reverse will occur.

It will be evident to those skilled in the art that while only single lines 54 are shown connecting the photoelectric elements 51 and the switching unit 53, the appropriate amplifying means and switching devices will be installed therebetween in conventional fashion.

With the arrangement of FIG. 12, a pattern will be formed on the sheet which is geometrically similar to the pattern formed on the perforated tape 50. Longitudinal distortion depends on the ratio between the advance of the punch tape 50 and that of the strip 2. The width of the patterning can be determined by the width of the strip 2. However, it is also possible to apply the same pattern in a number of adjacent strips upon the sheet of material 2 with a number of sets of electromagnetic switching units provided, in each case where the corresponding number of electromagnetic switching units in each set connected with a certain number of photoelectric elements in an operative manner.

These and other modifications may be made without departing from the spirit of the invention which is intended to be limited solely by the appended claims.

What is claimed is:

1. Apparatus for producing a pattern on a moving strip such as a textile web or the like comprising:

a. a trough located above the strip to be patterned containing therein a pattern producing liquid;

b. a roller supported above said trough for rotation therein to pick up on its surface said pattern producing liquid; and c. means for scraping in contact with the circumference of said roller to scrape said pattern producing liquid thereoff, said means being inclined toward said strip; wherein the improvement comprises:

d. a catch pan;

e. a plurality of liquid conducting channels arranged side-by-side in close proximity across the width of said means for scraping;

f. a plurality of positioning means for moving said individual channels between a first position in which said channels direct the material flowing from said means for scraping to said catch pan and a second position wherein liquid is permitted to flow onto the strip and g. said positioning means permitting individual, independent movement of said channels with respect to time as said moving strip moves therebelow, whereby different amounts of pattern producing liquid will be deposited on different areas of said strip with respect to time to cause a patterning thereof.

2. Apparatus according to claim 1 wherein said plurality of channels are pivoted a predetermined angular distance between said first and second positions, said pivoting being about a shaft transverse to said sheet.

3. Apparatus according to claim 2 wherein said channels are located below the lower end of said means for scraping and pivot about a pivoting axis located near the lower end of said means for scraping.

4. Apparatus according to claim 1 wherein said means for moving said channels comprise means for moving said channels transversely between said first and second positions.

5. Apparatus according to claim 4 wherein said channels are located below the lower end of said plate.

6. Apparatus according to claim 1 and further including means for causing said channels to oscillate between said second position and a position between said first and second positions.

7. Apparatus according to claim 1 wherein said means to cause oscillation comprise means operating said means to move to cause said channels to oscillate between said first and second positions.

8. Apparatus according to claim 7 wherein said means to move comprise electromagnetic drive means.

9. Apparatus according to claim 1 wherein said means to move comprise electromagnetic drive means.

10. Apparatus according to claim 8 wherein said electromagnetic drive means comprise:

a. a pair of permanent magnets;

b. a pair of DC electromagnets, one magnet of each of said pairs being stationary and the other magnet of each of said pairs attached to said channels; and further including:

c. control means for simultaneously reversing the polarity of the DC electromagnets.

11. Apparatus according to claim 1 wherein said channels comprise elongated channels open at the top and slanting toward the strip.

12. Apparatus according to claim 11 wherein said channels are inclined in the same direction as said means for scraping.

13. Apparatus according to claim 11 wherein said channels are inclined in a direction opposite to said means for scraping.

14. Apparatus according to claim 1 wherein said means for scraping comprises a scraper plate extending transverse to the strip and slanting downward, said plate having its upper edge resting against said roller to scrape said liquid therefrom with said liquid flowing from the lower edge of said plate into said channels.

15. Apparatus according to claim 14 and further including at least in the lower region of the plate, means for separating the liquid into a plurality of separate paths aligned with said channels.

16. Apparatus according to claim 14 wherein said plate contains a plurality of recesses at its upper edge contacting said roller, said recesses aligned with spaces between adjacent channels.

17. Apparatus according to claim 16 wherein barriers are provided running the full length of said plate, said barriers being aligned at the meeting point of adjacent channels to thereby avoid flow of liquid between channels.

18. Apparatus according to claim 15 wherein barriers are provided running the full length of said plate, said barriers being aligned at the meeting point of adjacent channels to thereby avoid flow of liquid between channels.

19. Apparatus according to claim 1 wherein said means for scraping comprise individual scraping blades, one being provided for each of said channels and providing liquid to individual channels.

20. Apparatus according to claim 1 and further including a drip catching plate located above the edge of said catch pan over which said channels pass when moving between said first and second positions catch pan and sloped toward the interior, said plate supported such that it provides on its underside a passage for the patterning liquid to flow into said catch pan.

* * * * *